United States Patent [19]

Cumbest et al.

[11] Patent Number: 4,902,191

[45] Date of Patent: Feb. 20, 1990

[54] PAIL LIFTER

[75] Inventors: Joseph B. Cumbest; Johnnie L. Briggs; Francis R. Jones, all of Amarillo, Tex.

[73] Assignee: Asarco Incorporated, New York, N.Y.

[21] Appl. No.: 806,868

[22] Filed: Dec. 9, 1985

[51] Int. Cl.[4] ..... B66C 1/00

[52] U.S. Cl. ..... 414/729; 414/685; 414/738; 187/9 R; 254/8 R; 254/10 R

[58] Field of Search ..... 254/8 R, 10 R, 8 B, 254/10 B; 414/738, 724, 729, 685, 785; 187/9 R

[56] References Cited

U.S. PATENT DOCUMENTS

| | | | |
|---|---|---|---|
| 1,751,480 | 3/1930 | Howell | 254/10 R X |
| 2,448,124 | 8/1948 | Roy | 414/738 |
| 2,570,741 | 10/1951 | Zeh | 254/8 R X |
| 3,291,448 | 12/1966 | Beebe | 254/10 R |
| 4,102,464 | 7/1978 | Schuster | 187/9 R |
| 4,133,435 | 1/1979 | Hosbein | 254/8 R X |
| 4,479,632 | 10/1984 | McIntire et al. | 254/8 B X |
| 4,482,130 | 11/1984 | Paredes | 254/8 R |

*Primary Examiner*—Joseph J. Rolla
*Attorney, Agent, or Firm*—John J. Tomaszewski; Kenneth A. Koch

[57] ABSTRACT

A mobile truck for moving containers and other articles comprising a base, supporting standards at opposite sides of the base, a handle pivotally attached at the upper ends of the standards, a lift supporting member pivotally attached to the handle and to a suitable lifter arm, the lifter arm having attached at one end a lifting device and the other end of the lifter arm being pivotally attached to a connecting bar, with the other end of the connecting bar being pivotally attached to the truck base.

6 Claims, 1 Drawing Sheet

PAIL LIFTER

BACKGROUND OF THE INVENTION

This invention relates to trucks and, more particularly, to manually operated trucks which are used for moving or transporting pails or similar containers or articles.

Prior trucks of this type have generally employed a suitable pail engaging clamp which can be raised or lowered by a pivotal swinging motion of a handle by which the trucks are propelled. Such typical trucks may be seen in U.S. Pat. Nos. 1,293,699; 1,410,991; 2,543,381; 2,570,741; and 2,681,712.

None of the trucks of the prior art enable the user to place or remove pails which are positioned, for example, in the middle of a pallet such as the standard 48 inch square pallet. And, in connection with the raising or lowering of the pail, it is a further benefit of the invention that the pail holding arm, and thus the pail itself, remains in a substantially horizontal position throughout its upward and downward movement. The present invention avoids the problems that have been commonly associated with the prior art trucks and enables the truck user to efficiently and effectively move and position heavy objects in places heretofore inaccessible.

SUMMARY OF THE INVENTION

A mobile truck for moving containers and other articles comprising a base, supporting standards at opposite sides of the base, a handle pivotally attached at the upper ends of the standards, a lift supporting member pivotally attached to the handle and to a suitable lifter arm, the lifter arm having attached at one end a lifting device and the other end of the lifter arm being pivotally attached to a connecting bar, with the other end of the connecting bar being pivotally attached to the truck base.

DESCRIPTION OF THE PREFERRED EMBODIMENT

Figure 1:
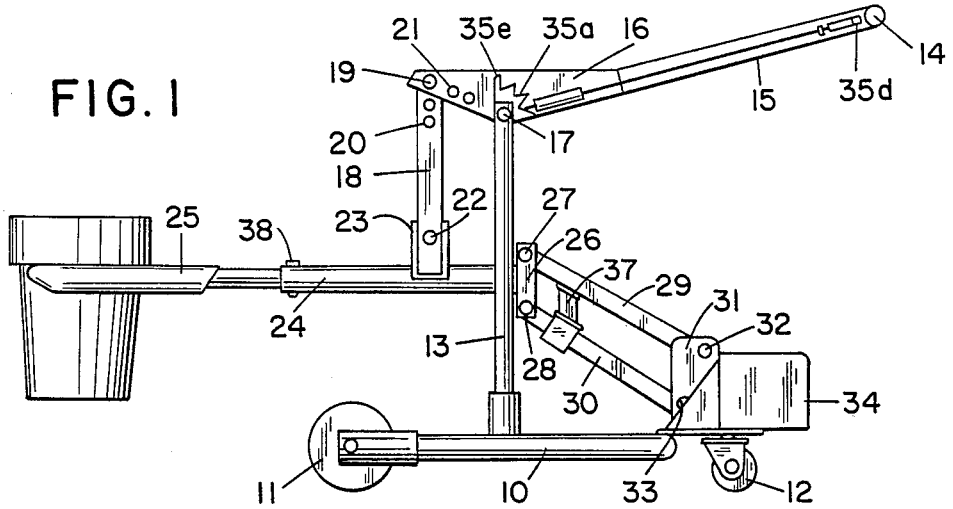
FIG. 1 is a side view of the truck, showing the parts in a pail engaging lifted position suitable for transporting the pail.
Figure 2:
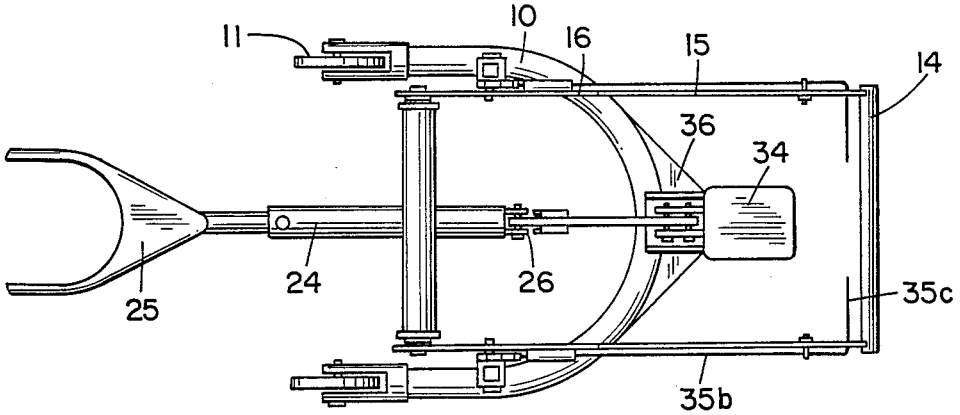
FIG. 2 is a top view of the truck.
Figure 3:
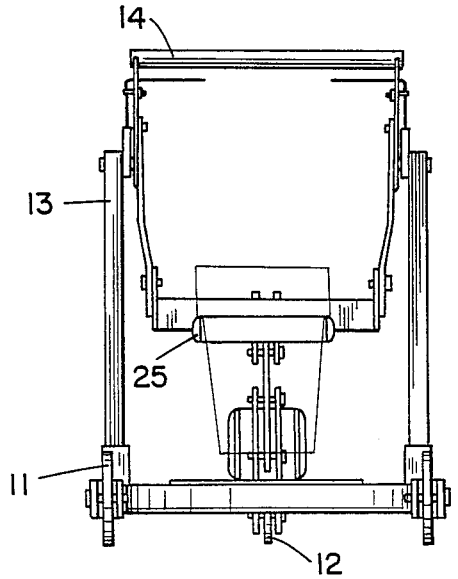
FIG. 3 is a front view of the truck shown in the position of FIG. 1.

FIG. 1 is a side view of the truck and comprises a base 10, having suitable wheels or rollers 11 and 12 preferably at its front and rear ends and main supporting standards 13 mounted at opposite sides of the base. Pivoted at the upper ends of the standards 13 is a handle preferably of U-shape formation in that it comprises a cross-bar 14 forming a handle and side members 15, the free ends of the latter being of increased width as indicated at 16 with these end portions 16 journaled on pivot pins 17 mounted in the standards 13. The enlarged portions 16 of the handle ends have pivotally attached thereto lift supporting members 18 journaled on pivot pins 19. In order to vary the distance the lift supporting members 18 may be raised, lowered or positioned, the lift supporting members 18 and the end portions 16 of the handle are each provided with a series of holes 20 and 21 for reception of the pivot pins 19.

Pivotally connected at 22 to the lift supporting member 18 is a cross-brace 23, the brace being rigidly joined to lifter arm 24. Joined to one end of the lifter arm 24 is a suitable lifting device 25, which for use as a pail lifter is semicircular in shape with extended straight sections. Joined to the other end of lifter arm 24 is a frame member 26 having pivot points 27 and 28 and connecting bars 29 and 30 pivotally attached thereto. The other ends of connecting bars 29 and 30 are pivotally connected to frame 31 at pivot points 32 and 33. The connecting bars are restrained in their upward movement by a stop 37 which lends added stability to the truck, especially at the upper limit of lifting. The stop 37 is rigidly joined to connecting bar 29 and slides over bar 30 as the handle 14 is raised or lowered. A counterweight 34 is positioned adjacent to frame 31, the frame and counterweight being secured to base 10. Added reinforcement is provided by supports 36.

A conventional ratchet mechanism, e.g., spring actuated, is provided to retain the lifting device in the desired position. Each main supporting standard 13 has as part of its construction or rigidly mounted thereon a member **35*a* having a series of teeth. The teeth are engaged by rods 35*b* which extend along the sides 15 of the handle to a point in proximity to cross-bar 14 at which point they are formed with lateral extensions 35*c* which extend through slots 35*d* in the handle, these extensions 35*c* being located sufficiently close to the cross-bar 14 of the handle so that the operator, when desiring to engage the rods 35*b* with the teeth of member 35*a* can do so by simply gripping the extensions 35*c* without actually moving his hand or hands from the cross-bar 14 of the handle. At the top of member 35*a* is a stop 35*e* which limits upward travel of the handle 14**.

Replacement of the lifting device 25 may be easily performed by providing a bolt or other fastener device at point 38 on the lifter arm 24.

While the present invention has been described with a degree of particularity, it should be appreciated that modifications and alterations other than those disclosed may be made without departing from the spirit of scope of the invention as set forth in the appended claims.

We claim:

1. A mobile truck for moving containers and other articles comprising a base, supporting standards at opposite sides of the base, said standards having upper and lower ends, a handle pivotally attached at the upper ends of the standards, a lift supporting member pivotally attached to the handle and to a suitable lifter arm, the lifter arm having attached at one end a lifting device and the other end of the lifter arm being pivotally attached to a connecting bar, with the other end of the connecting bar being pivotally attached to the truck base.

2. The mobile truck of claim 1 wherein there are at least two lift supporting members.

3. The mobile truck of claim 1 in which there are at least two pivot points on the lifter arm and a corresponding number of connecting bars being pivotally attached thereto and to the truck base.

4. A mobile truck for moving containers and other articles comprising a base, supporting standards at opposite sides of the base, said standards having upper and lower ends, a handle pivotally attached at the upper ends of the standards, lift supporting members pivotally attached to the handle, a cross-brace pivotally attached to the lift supporting members, the cross-brace being rigidly joined to a lifter arm, a lifting device attached at one end to the lifter arm and the other end of the lifter arm having at least two pivot points and being pivotally attached to connecting bars, with the other ends of the connecting bars being pivotally attached to the truck base.

5. The mobile truck of claim 4 further having a ratchet mechanism to retain the lifting device in the desired position.

6. The mobile truck of claim 5 further having a counterweight to prevent tipping of the truck during use.

* * * * *